United States Patent [19]

Zanfini

[11] 4,064,627

[45] Dec. 27, 1977

[54] CARPET CUTTER

[76] Inventor: Vincent Zanfini, 7569 SE. Gull Way, Hobe Sound, Fla. 33455

[21] Appl. No.: 750,838

[22] Filed: Dec. 15, 1976

[51] Int. Cl.[2] ..... B26B 29/00

[52] U.S. Cl. ..... 30/287; 30/294

[58] Field of Search ..... 30/294, 286, 287, 289

[56] References Cited

U.S. PATENT DOCUMENTS 2,238,678 4/1941 Cook ..... 30/294

3,934,341 1/1976 Carlson ..... 30/294

*Primary Examiner*—Robert C. Watson

*Attorney, Agent, or Firm*—Wolf, Greenfield & Sacks

[57] ABSTRACT

A carpet cutter having a base with guiding side edges and also having a vertical frame. The frame carries a pair of downwardly diverging blades, each of which intersects a carpet slot, and a handle is affixed to the top of the frame so that the cutter may be used conveniently in either direction and by either hand.

3 Claims, 4 Drawing Figures

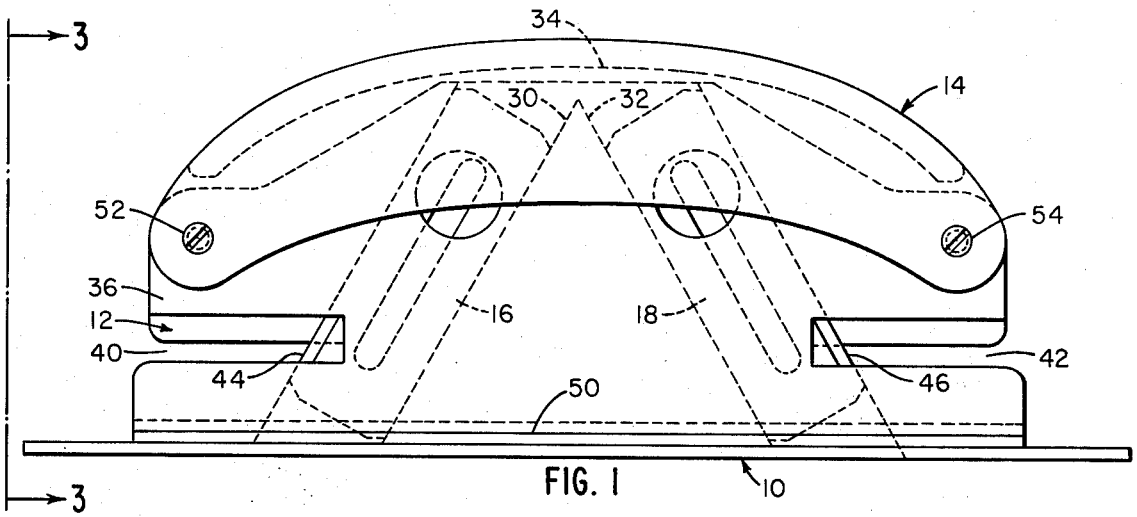
FIG. 1
FIG. 2
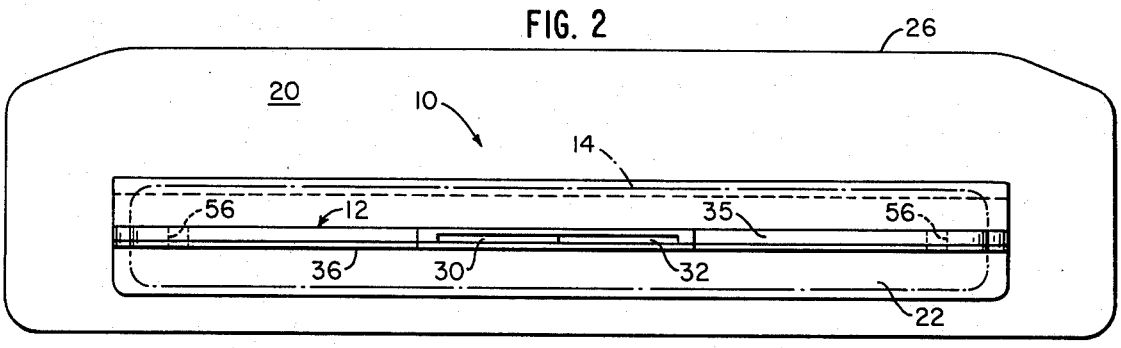
FIG. 4
FIG. 3
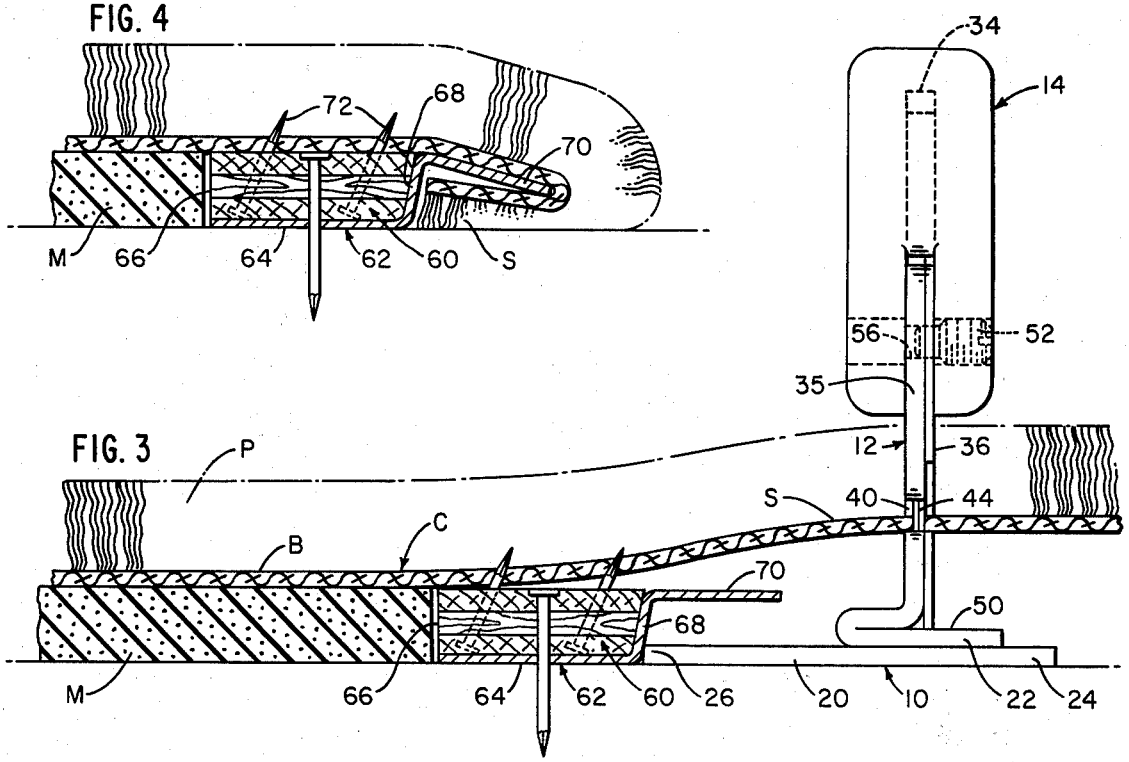

CARPET CUTTER

INTRODUCTION

This invention relates to carpet cutters and more particularly comprises an improvement over cutters of the type shown in U.S. Pat. Nos. 3,543,400 and 3,543,401.

The cutter of this invention is particularly designed for use with a carpet tacking strip that has a flange about which the carpet secured to it is wrapped so as to provide a finished edge for the carpeting, without the use of molding, etc. at the edge. The cutter of this invention includes guide means that cooperates with the tacking strip itself so as to form the carpet with a selvage beyond the edge of the tacking strip that is of the proper length to be folded under tacking strip flange. The tool has a second guide means that is a different distance from the plane of the blades than is the other guide means so that the selvage may be either larger or smaller as desired.

The cutter is also provided with a pair of blades that allow the cutter to either be pushed away from or drawn toward the carpet layer as is convenient for him. This feature provides more versatility for the instrument than is available in such prior cutters as shown in the patents identified above.

This invention will be more fully understood and appreciated from the following detailed description of one embodiment thereof, selected for purposes of illustration and shown in the accompanying drawing.

BRIEF FIGURE DESCRIPTION

FIG. 1 is an elevation view of one side of the carpet cutter embodying this invention.

FIG. 2 is a plan view thereof.

FIG. 3 is an end view of the carpet cutter of this invention taken in the direction suggested by sight line 3—3 of FIG. 1 and showing the manner in which the cutter may be used in cooperation with a tacking strip to cut carpeting.

FIG. 4 is a cross sectional view showing the manner in which the carpet cut as suggested in FIG. 3 is anchored to the strip.

DETAILED DESCRIPTION

The carpet cutter shown in the drawing includes a base 10 and a generally vertical frame 12 that together constitute the body of the device. The frame 12 carries a handle 14 which facilitates handling of the cutter and enables the operator to draw the device smoothly as it cuts the carpeting. The cutter also includes a pair of cutting blades 16 and 18. Each of these separate elements is described in detail below.

The base 10 as shown in FIG. 3 includes a horizontal plate 20 whose lower surface is intended to be drawn across the floor on which the carpet is being cut. The frame 12 has a horizontal flange 22 which may be welded, screwed, or otherwise fastened to the plate 20 so that the two are permanently secured to one another. It will be noted in FIGS. 2 and 3 that the frame 12 does not lie along the center of base plate 20 but rather is disposed closer to one side edge 24 than the other edge 26. This arrangement increases the versatility of the cutter by enabling it to cut along lines at different distances from an edge provided as a guide for the cutter. For example, as will be explained in detail below, when the cutter is drawn along the side of a tacking strip, the frame 12 may lie substantially against a portion of the strip or may be spaced therefrom depending upon which of the two edges 24 and 26 is used as a guide in cooperation with the strip.

The vertical frame 12 is provided with a pair of downwardly diverging blade slots 30 and 32 which generally merge at the center of the frame along its top edge 34. The slots 30 and 32 are formed in the inner face of plate 35 and are closed by the cover plate 36 which lies in face to face relationship with plate 35 to form the vertical frame of the cutter. The plates 35 and 36 are substantially co-extensive.

A pair of horizontal slots 40 and 42, each of which is designed to receive the carpeting to be cut, are provided in the frame 12 disposed a short distance above the base 10. The horizontal slots 40 and 42 intersect the blade slots 30 and 32, respectively, as is evident in FIG. 1. Consequently, when blades 16 and 18 are inserted in blade slots 30 and 32 between plates 35 and 36, their cutting edges 44 and 46 are exposed in the slots 40 and 42 in a position to cut the carpeting which is fed toward the blade in one or the other of the horizontal respective slots. The blades 16 and 18 fit firmly in the blade slots 30 and 32 with their cutting edges forming an obtuse angle with the slots. The inclined angle of the blades assists in the cutting of the carpeting. The lower ends of the blades rest on the upper surface 50 of the horizontal flange 22 of the frame.

The handle 14 is shown in the drawing to be held in place by a pair of recessed screws 52 and 54, one at each end of the handle. The screws pass through appropriate holes 56 provided in the frame, and the handle covers the tops of the blade slots 30 and 32 when in place. In order to change the blades, one or the other of the screws 52 and 54 must be loosened so as to clear its respective hole 56 in the frame so that the handle may be pivoted about the other of the screws and expose the top of the blade slots. Normally the blades 16 and 18 are double edged so that they may be inverted to enable each of the edges to be used before they must be discarded.

The manner in which the cutter of FIGS. 1 and 2 may be used is suggested in FIGS. 3 and 4. In FIG. 4 a tacking strip 60 is shown having a aluminum trough 62 that is generally U-shaped and defined by bottom wall 64 and side walls 66 and 68. Wall 66 is shown in FIG. 4 to be vertical while wall 68 is shown to be slightly inclined to the vertical. The side wall 68 carries outwardly extending flange 70 connected to the top of the wall 68 and about which the carpeting is tucked in the fashion shown in FIG. 4. The carpeting C is shown in FIG. 4 to consist of a backing B and pile P. The carpeting overlies the mat M which abuts against wall 66 of the channel 62 of the tacking strip 60, and mat M is substantially the same height as the channel. Channel 62 contains a number of wooden strips in which are embedded the tacks 70 that are designed to extend through the backing B of the carpet in the fashion shown in FIGS. 3 and 4. To cut the carpeting C so that there is a selvage S that may be tucked under the flange 70 of the channel 62, the cutter is drawn along the outer edge of the side wall 68 of the channel in the fashion shown in FIG. 3. Because of the presence of the oppositely facing blades 16 and 18 with the slots 40 and 42, the cutter may be pushed or pulled in either direction to cut the carpeting. The length of the base plate 20 from its edge 26 to the plane of the blades 16 and 18 is such that when the cutter is operated in the fashion shown in FIG. 3, a selvage S is left on the carpeting of sufficient width so that it may be tucked about the flange 70 which is then bent downwardly so as to hold the selvage in place in the manner shown in FIG. 4. It is evident that if a smaller selvage is desired, the edge 24 of the base plate 20 may be used as a guide and be drawn along the outer surface of the side wall 68 of the channel.

Having described this invention in detail those skilled in the art will appreciate that numerous modifications may be made thereof without departing from its scope. Therefore, it is not intended that the breadth of this invention be limited to the specific embodiment illustrated and described. Rather it is to be determined by the appended claims and their equivalents.

I claim:

1. A carpet cutter comprising a base adapted to be drawn across the floor and having a plate that fits under the flange of an anchoring strip about which the edge of the carpet is to be folded so that the edge of the plate forms a guide for the cutter, a generally vertical frame mounted on the base and having opposed ends and generally flat vertical surfaces, a pair of horizontal slots in the frame extending toward the center of the frame, one from each end and disposed above the base, a pair of blades provided in the frame between the flat vertical surfaces and with one blade intersecting each horizontal slot, said blades lying in a plane parallel to the edge of the plate and spaced from said edge a distance which causes the cut made by either blade to form a margin on the carpet that can be folded under the flange, and a handle for manually engaging the cutter and carried on the frame.

2. A carpet cutter as described in claim 1 further characterized by a pair of blade slots in the frame between the vertical surfaces for supporting the blades, each of said blade slots being inclined to the vertical so as to support the blades at inclined positions with respect to the horizontal slots in the plate.

3. A carpet cutter as described in claim 2 further characterized by each of said blade slots being at an obtuse angle with the horizontal slots so that the blades in them extend upwardly and away from the open end of the horizontal slot which it intersects.

* * * * *